US010661555B2

(12) United States Patent
Chu et al.

(10) Patent No.: US 10,661,555 B2
(45) Date of Patent: May 26, 2020

(54) DOCTOR BLADE HOLDER AND ADJUSTMENT MECHANISM

(71) Applicant: Mark Andy Inc., Chesterfield, MO (US)

(72) Inventors: Dat Chu, St. Louis, MO (US); William Ross North, Washington, MO (US)

(73) Assignee: Mark' Andy, Inc., Chesterfield, MO (US)

( * ) Notice: Subject to any disclaimer, the term of this patent is extended or adjusted under 35 U.S.C. 154(b) by 164 days.

(21) Appl. No.: 15/616,060

(22) Filed: Jun. 7, 2017

(65) Prior Publication Data

US 2017/0348965 A1 Dec. 7, 2017

Related U.S. Application Data

(60) Provisional application No. 62/346,674, filed on Jun. 7, 2016.

(51) Int. Cl.
*B41F 31/02* (2006.01)

(52) U.S. Cl.
CPC ..... *B41F 31/022* (2013.01)

(58) Field of Classification Search
CPC ..... B41F 9/1027; B41F 9/1036; B41F 9/10; B41F 31/02
See application file for complete search history.

(56) References Cited

U.S. PATENT DOCUMENTS 2,854,923 A * 10/1958 Huck ..... B41F 9/1036 101/157
3,006,275 A * 10/1961 Allen ..... B41F 9/1036 101/157
6,360,660 B1 * 3/2002 Allison, Jr. ..... B41F 9/10 101/169

OTHER PUBLICATIONS

Kren, "Know Your Thrust Bearings," Apr. 12, 2007, Machine Design (Year: 2007).*

* cited by examiner

*Primary Examiner* — Judy Nguyen
*Assistant Examiner* — Leo T Hinze
(74) *Attorney, Agent, or Firm* — Banner & Witcoff, Ltd.

(57) ABSTRACT

A doctor blade holder and adjustment mechanism that may be utilized with a flexographic printing system. The doctor blade holder and adjustment mechanism may utilize a constant displacement of the doctor blade against an anilox roller, rather than a constant force, to reduce ink build up on the back side of the doctor blade, and subsequently, intermittent dropping of the accumulated ink onto the post-shearing side of the anilox roller ("spitting"). The doctor blade holder and adjustment mechanism may provide adjustability of a combination of doctor blade pressure, angle and displacement.

17 Claims, 8 Drawing Sheets

$$\delta_{MAX} = \frac{N_{SIN}\theta_3 \times L_3^3}{3EI}$$

WHERE E : YOUNG MODULUS OF BLADE MATERIAL

I : AREA MOMENT OF INERTIA

DOCTOR BLADE HOLDER AND ADJUSTMENT MECHANISM

CROSS-REFERENCE TO RELATED APPLICATIONS

This application claims priority to U.S. Provisional Application No. 62/346,674, filed Jun. 7, 2016, which is expressly incorporated herein by reference in its entirety for any and all non-limiting purposes.

BACKGROUND

A flexographic printing unit may utilize a doctor blade to meter, or control, an amount of ink on an anilox roller. The doctor blade may scrape the anilox roller to shear off ink that is over the top of any of the anilox cells that make up the anilox roller. However, in some instances, a doctor blade may allow ink to accumulate on a back side of the doctor blade (non-scraping side). In turn, the accumulation of ink may intermittently drop onto the anilox roller (at a position on the anilox roller after the point of shearing), which is detrimental since it may result in excess ink being transferred to a printing plate/plate cylinder. This accumulation of ink and intermittent dropping onto the post-shearing side of the anilox roller may be referred to as "spitting." A need, therefore, exists, for an improved doctor blade holder and adjustment mechanism that may be utilized to reduce or eliminate this spitting phenomenon. Aspects of the disclosed innovation address the above-referenced and other deficiencies in conventional adjustment mechanisms and doctor blade holders.

BRIEF SUMMARY

The following Summary is provided as an overview of some of the several aspects disclosed herein. Nothing within this Summary should be construed as limiting with respect to claim scope for one or more related applications. Rather, the Summary is intended to introduce the reader onto some novel aspects disclosed herein.

According to one aspect, a doctor blade holder may include a loading brace that is rotatably-coupled to a doctor blade stiffener plate at first and second ends. Further, the doctor blade stiffener plate may be rigidly-coupled to a doctor blade as a bottom side. The doctor blade holder may further have an adjustment knob mechanism, and an adjustment shaft that linearly-translates from actuation of the adjustment knob mechanism. Linear translation of the adjustment shaft may be converted into rotation of the doctor blade stiffener plate relative to the loading brace. The doctor blade holder may also have a backlash compression spring that is compressed between the adjustment knob mechanism and the doctor blade stiffener plate. A spring force exerted by the backlash compression spring on the doctor blade stiffener plate may reduce backlash from tolerance stack up within the adjustment knob mechanism and the connection of the doctor blade holder to the machine body. The backlash compression spring may also dampen vibrations of the within the printing system that can cause chatter in the doctor blade, which may allow ink to work its way to the back side of the doctor blade. Further, the doctor blade stiffener plate may hold the doctor blade at a constant displacement position such that a normal force exerted by the doctor blade against an uneven surface may vary as the doctor blade moves relative to the uneven surface but the displacement of the point at which the doctor blade is held within the doctor blade holder may remain at a constant displacement position.

In another aspect, a doctor blade holder may include a doctor blade stiffener plate that may be rigidly-coupled to a doctor blade as a bottom side. The doctor blade holder may further have an adjustment knob mechanism, and an adjustment shaft that linearly-translates from actuation of the adjustment knob mechanism. Linear translation of the adjustment shaft may be converted into rotation of the doctor blade stiffener plate relative to an anilox roller of a flexographic printing system. The doctor blade holder may also have a backlash compression spring that is compressed between the adjustment knob mechanism and the doctor blade stiffener plate. A spring force exerted by the backlash compression spring on the doctor blade stiffener plate may reduce backlash from tolerance stack up within the adjustment knob mechanism and the connection of the doctor blade holder to the machine body.

In certain embodiments, rotation of the doctor blade stiffener plate may move the doctor blade toward or away from an anilox roller of a flexographic printing system. There may be two stiffener plates and the doctor blade is clamped between the first and second stiffener plates. In one implementation, there may be two or more doctor blade mounting arms rigidly-coupled to the loading brace. The doctor blade mounting arms may include respective thrust bearings that rotatably couple the doctor blade stiffener plate to the loading brace.

In further embodiments, a connecting shaft may be rigidly coupled between a first and second doctor blade mounting arms. The connecting shaft may also be a stop element that prevents the doctor blade stiffener plate from being rotated beyond a predetermined stop position. In other embodiments, a doctor blade loading arm may be rigidly coupled to the doctor blade stiffener plate, and the adjustment shaft may be configured to exert a force on the doctor blade loading arm resulting in a moment about a rotational axis through the doctor blade stiffener plate. In one implementation, the backlash compression spring may as a spring constant between 700 and 800 lbs./in. The backlash compression spring may be a cylindrical spring with a constant pitch. In further embodiments, the doctor blade holder may include an ink flap that is rigidly coupled to the second doctor blade stiffener plate.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different component of one single embodiment; however, the disclosed embodiments are not limited to that particular scale.

DETAILED DESCRIPTION

Aspects of this disclosure relate to improved doctor blade holders and adjustment mechanisms that may be utilized with, for example, a flexographic printing system. Advantageously, the doctor blade holder and adjustment mechanism described herein may utilize a constant displacement of the doctor blade against an anilox roller, rather than a constant force, to reduce ink build up on the back side of the doctor blade, and subsequently, intermittent dropping of the accumulated ink onto the post-shearing side of the anilox roller ("spitting"). This constant displacement functionality is further facilitated by the doctor blade holder and adjustment mechanism providing adjustability of a combination of doctor blade pressure, angle and displacement.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1:
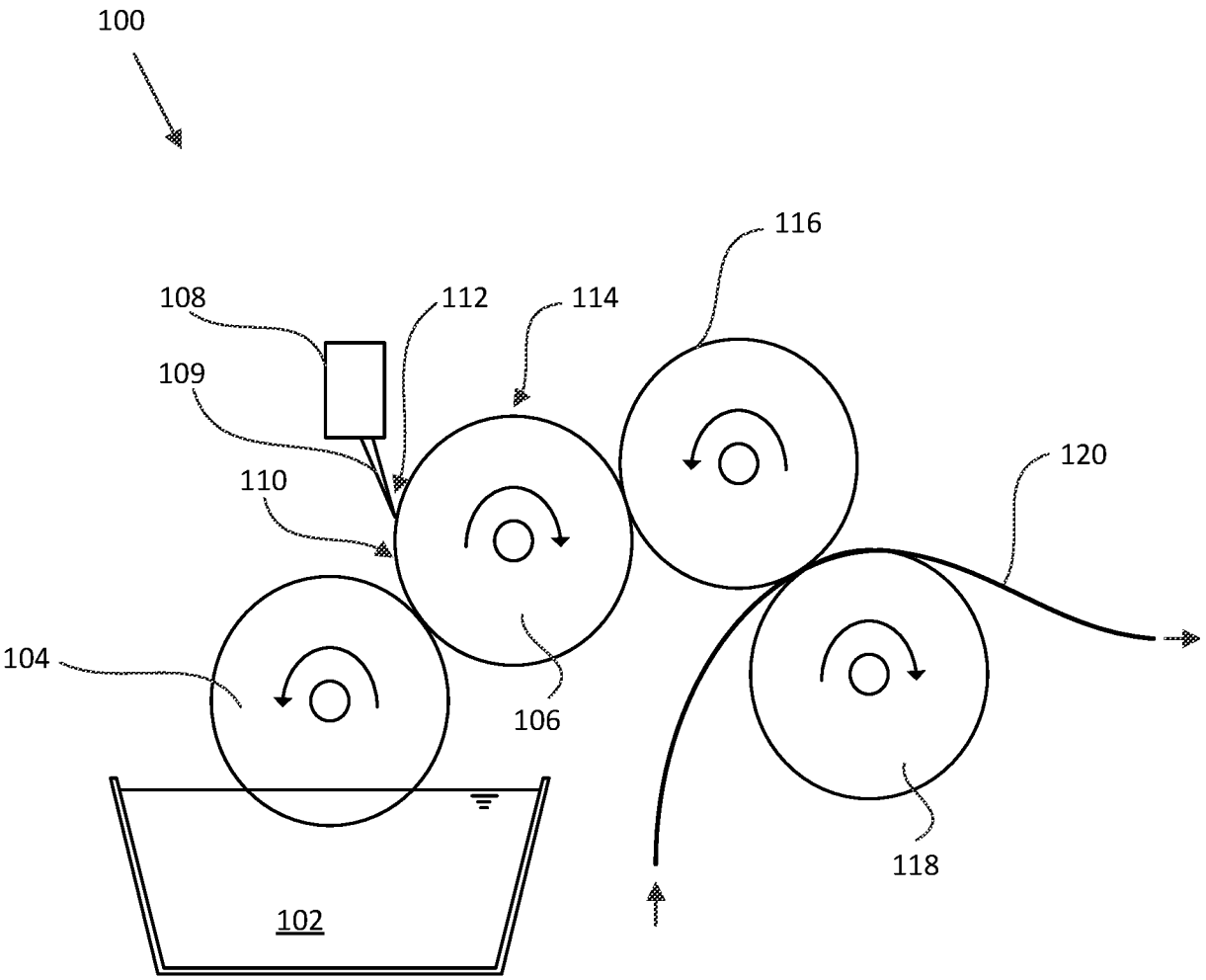
FIG. 1 schematically depicts a flexographic printing system, according to one or more aspects described herein.

FIG. 1 schematically depicts a flexographic printing system 100, according to one or more aspects described herein. In one example, the system 100 may include an ink fountain 102. As such, the ink fountain 102 may store a volume of printing ink that is used to print onto a substrate 120. A metering roller 104, otherwise referred to as a meter roller, or fountain roller, may be used to transfer ink from the ink fountain 102 to an anilox roller 106. The anilox roller 106, in turn, may transfer ink between the metering roller 104 and the plate cylinder 116. The anilox roller 106 may have a plurality of recessed cells on an outer cylindrical surface configured to control the amount of ink transferred between the metering roller 104 and a plate cylinder 116. A doctor blade 109 may be utilized to remove excess ink from the anilox roller 106 by scraping the surface of the anilox roller 106 to shear off any ink that is over the top of any of the plurality of cells of the anilox roller 106. Accordingly, the area of the anilox roller 106 that may have an excess amount of ink, otherwise referred to as the "scraping side" of the anilox roller 106, is labeled as element 110 in FIG. 1.

Following the scraping of the anilox roller 106 by the doctor blade 109, the scraped area of the anilox roller 106, or post-shearing side, and schematically labeled as area 114, may transfer ink to the plate cylinder 116. The plate cylinder 116 may be utilized to hold the printing plate (not depicted in FIG. 1), which may include a flexible relief. In turn, the substrate 120 may be printed using the printing plate attached to the printing cylinder 116, with an impression cylinder 118 applying pressure to the plate cylinder 116 as the substrate 120 is fed between the printing cylinder 116 and the impression cylinder 118 in the direction schematically indicated by the arrows in FIG. 1. It is contemplated that the system 100 schematically depicted in FIG. 1 may be utilized to print onto various substrate materials, without departing from the scope of these disclosures.

In one implementation, the doctor blade 109 may be held and adjusted using a doctor blade holder and adjustment mechanism 108. Advantageously, the doctor blade holder and adjustment mechanism 108 may be utilized to position the doctor blade 109 against the anilox roller 106 with a constant displacement. The doctor blade holder and adjustment mechanism 108 may provide adjustability of a combination of doctor blade pressure, angle, and displacement. Advantageously, the doctor blade holder and adjustment mechanism 108 may reduce or prevent buildup of ink on the backside 112 of the doctor blade, which may in turn reduce or prevent intermittent dropping of the accumulated ink onto the post-shearing side 114 of the anilox roller 106, which is a problem that is otherwise referred to as "spitting." By positioning the doctor blade 109 with a constant displacement against the anilox roller 106, the doctor blade holder and adjustment mechanism 108 may, advantageously, increase the working life (e.g., by reducing the rate of wear) of the doctor blade 109 when compared to an alternative mechanism that may position a doctor blade against an anilox roller with a constant force. Further advantageously, the doctor blade holder and adjustment mechanism 108 may position the doctor blade 109 with a constant displacement and utilize a backlash compression spring 15 to absorb vibrations within the flexographic printing system 100, which may in turn reduce or prevent fluctuation of pressure applied to the doctor blade 109 as the various components of the system 100 move and vibrate. As such, this reduction or prevention of fluctuation of pressure applied to the doctor blade 109, otherwise referred to as "blade chatter," may reduce or prevent ink slipping past the doctor blade 109 to build up on the backside 112 of the doctor blade 109.

It is contemplated that the systems and methods described herein in relation to the flexographic printing system 100 may be utilized without one or more of the components described in relation to FIG. 1. For example, the flexographic printing system 100 may not utilize the metering roller 104, without departing from the scope of these disclosures. Additionally, the flexographic printing system 100 may include additional elements to those described in relation to FIG. 1, without departing from the scope of these disclosures. Indeed, systems other than a traditional flexographic printing systems are envisioned.

Figure 2:
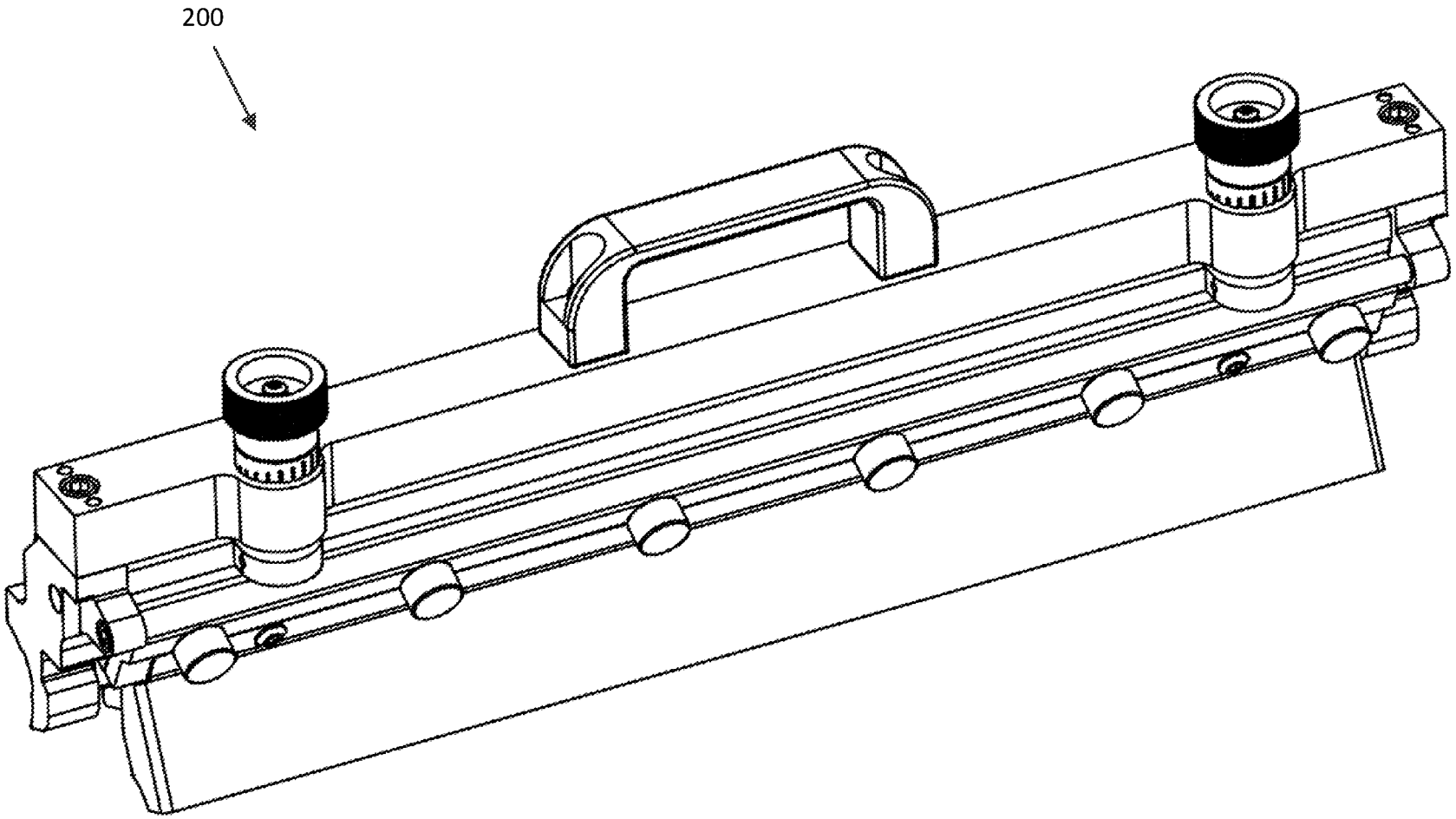
FIG. 2 depicts a first isometric view of a doctor blade holder and adjustment mechanism, according to one or more aspects described herein.
Figure 3:
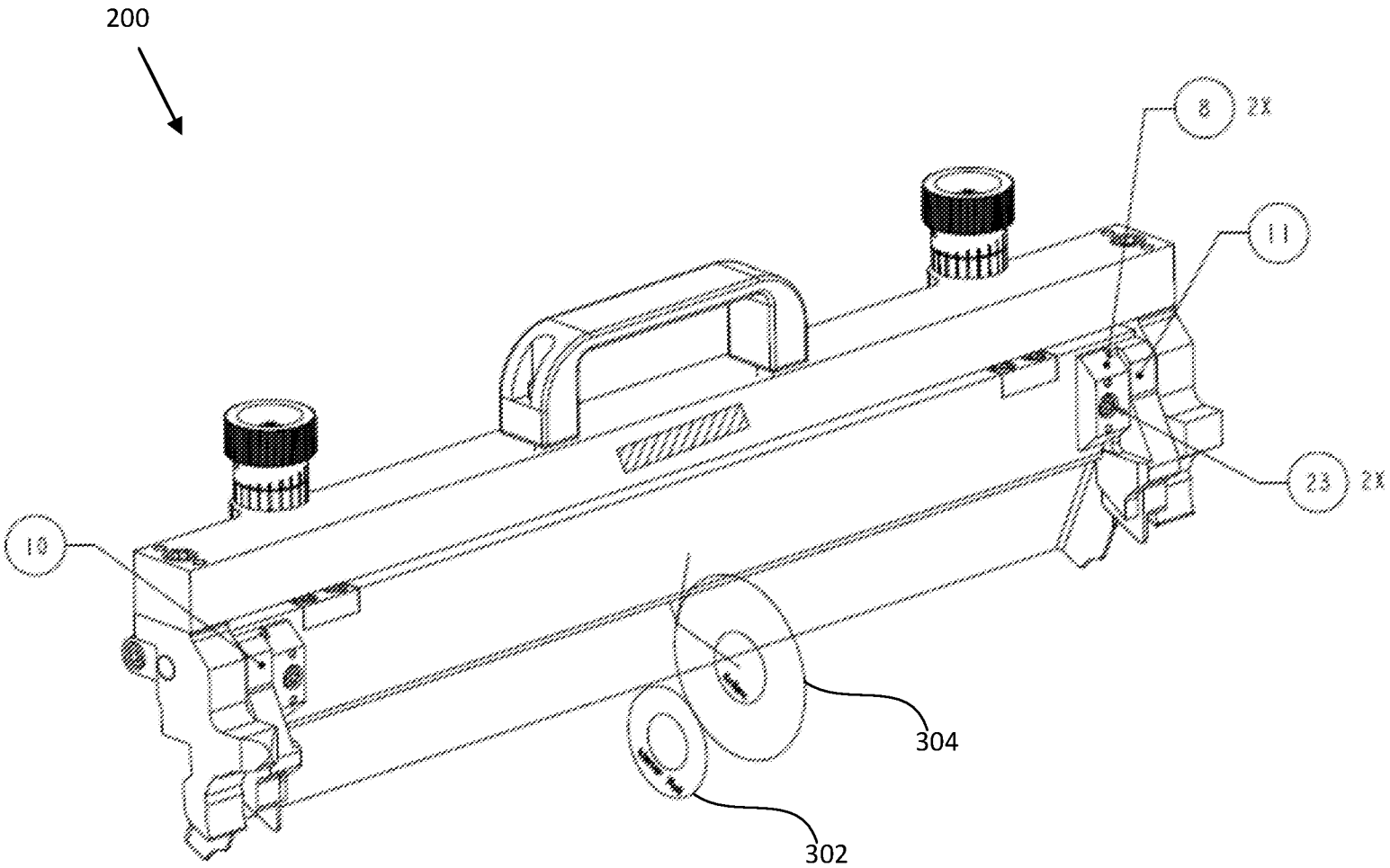
FIG. 3 depicts a second isometric view of the doctor blade holder and adjustment mechanism of FIG. 2, according to one or more aspects described herein.

FIG. 2 depicts a first isometric view of a doctor blade holder and adjustment mechanism 200, according to one or more aspects described herein. As such, the doctor blade holder and adjustment mechanism 200 may be similar or identical to that mechanism 108 schematically depicted in FIG. 1. In yet other embodiments, mechanism 200 is not similar or identical to mechanism 108. Additionally, FIG. 3 depicts a second isometric view of the doctor blade holder and adjustment mechanism 200, according to one or more aspects described herein. In particular, the isometric view of FIG. 3 may be referred to as a backside view of the mechanism depicted in FIG. 2. Further depicted in FIG. 3 are schematic representations of a metering roller 302 and an anilox roller 304, which may be similar or identical to metering roller 104 and anilox roller 106 from FIG. 1. Accordingly, the various components of the doctor blade holder and adjustment mechanism 200 are described in further detail in relation to the exploded view of FIG. 4.

Figure 4:
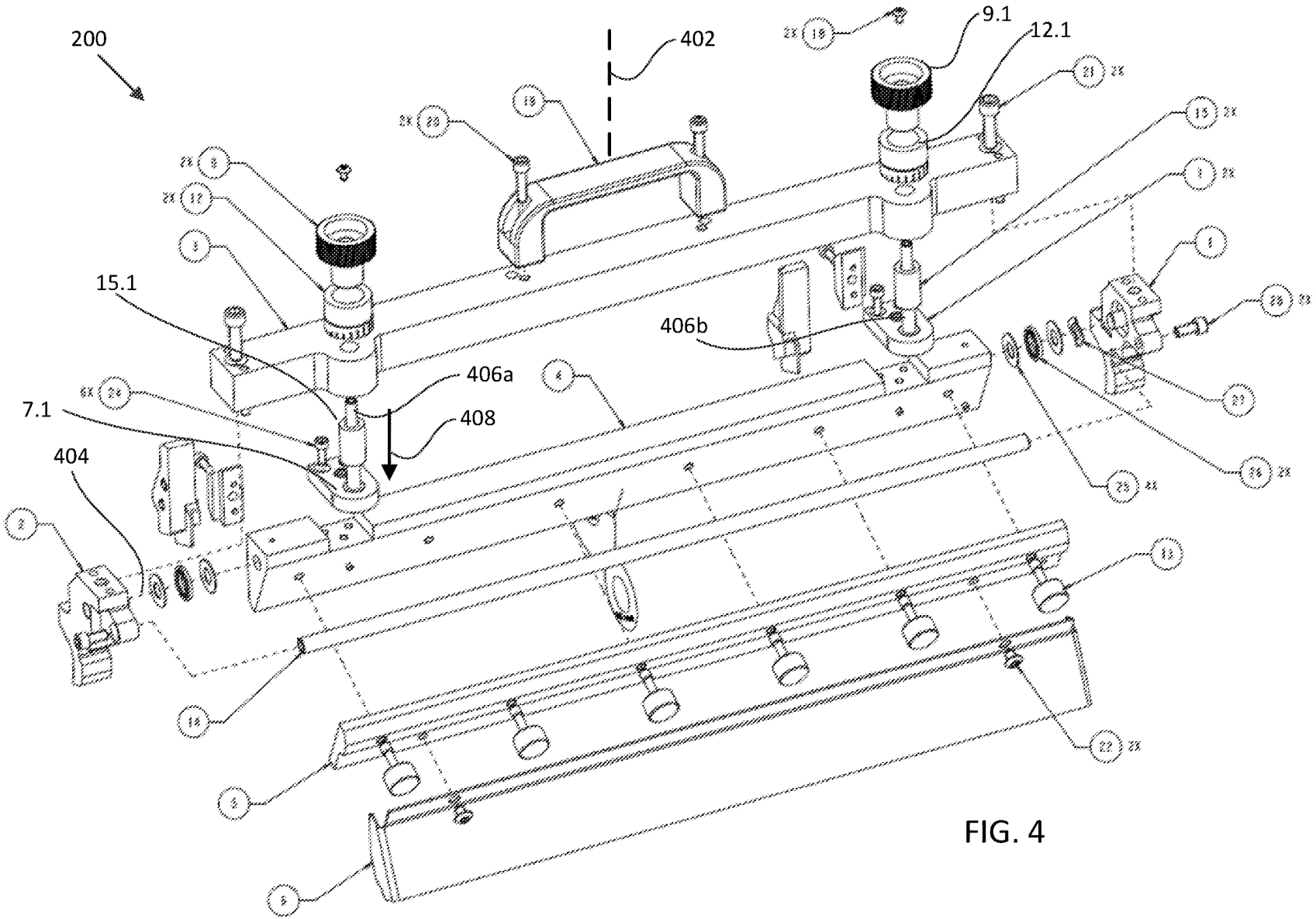
FIG. 4 depicts an exploded isometric view of the doctor blade holder and adjustment mechanism, according to one or more aspects described herein.

FIG. 4 depicts an exploded isometric view of the doctor blade holder and adjustment mechanism 200, according to one or more aspects described herein. As depicted, the doctor blade holder and adjustment mechanism 200 includes subcomponents, with the depicted labels corresponding to the following subcomponent descriptions in Table 1:

TABLE 1

| Label No. | Description |
|---|---|
| 1 | First doctor blade mounting arm |
| 2 | Second doctor blade mounting arm |
| 3 | Doctor blade loading brace |
| 4 | Doctor blade stiffener plate |
| 5 | Doctor blade stiffener plate |
| 6 | Doctor blade ink flap |
| 7 | Doctor blade loading arm |
| 8 | Ink wiper retainer bracket (depicted FIG. 2) |
| 9 | Doctor blade adjustment knob |
| 10 | Ink wiper (operator side) (depicted in FIG. 3) |
| 11 | Ink wiper (gear side) |
| 12 | Adjustment knob indicator |
| 13 | Doctor blade clamp screw |
| 14 | Connecting shaft |
| 15 | Backlash compression spring. (In one implementation: 0.600ODX .I25XILG MW 777.7 LB/IN) |
| 18 | Fastener (e.g. a screw or bolt among others). In one implementation:. SCW, BTN HD SOC CAP 8-32UNRCX.25 ST/STL) |
| 19 | Handle |
| 20 | Fastener. In one implementation: SHCS 1/4-20 X .87 SS) |
| 21 | Fastener. In one implementation: SCW. SOC HD CAP 5/16-18XI BLACK |
| 22 | Fastener. In one implementation: B.H.S.C.S. 1/4-20 × ¼" |
| 23 | Fastener. (Depicted in FIG. 3.) In one implementation: SCW, SOC HD CAP 10-32UNRF-3AX3/8 |
| 24 | Fastener. In one implementation: SCW, SOC HD CAP 10-32UNF X1/2 ST/STL |
| 25 | Thrust bearing washer. In one implementation: 3/8 ID, 13/16 OD, 1/32 THK, |
| 26 | Thrust bearing. In one implementation: 3/8 ID, 13/16 OD, 5/64 THK, NTA-613 |
| 27 | Triple wave spring washer. In one implementation: 0.391 ID, 0.682OD, 0.01 TH, 0.08H |
| 28 | Fastener. In one implementation: SCW, SOC HD CAP 1/4-20UNRC-3AX1/2 |

It is noted that the doctor blade holder and adjustment mechanism 200 depicted in FIG. 4 may have one or more elements that are symmetrical about, in one implementation, centerline 402. As such, some elements are only labeled once in FIG. 4, and it should be understood that an unlabeled element may be similar to a labeled element depicted in a symmetrical position about the centerline 402. In another example, elements labeled as "x.1" (e.g. elements 7.1, 9.1, 12.1 and 15.1) may be interpreted as being similar to those symmetrical elements labelled as "x" (e.g. elements 7, 9, 12 and 15, respectively).

It is further noted that a doctor blade is not depicted in FIG. 4. As such, the doctor blade may be held between the doctor blade stiffener plate 4 and the doctor blade stiffener plate 5 by the doctor blade clamp screws 13.

In one example, the doctor blade loading brace 3 may be rigidly-coupled to the first doctor blade mounting arm 1 and to the second doctor blade mounting arm 2. Further, the rigid assembly of the loading brace 3, the mounting arm 1 and the mounting arm 2 may be rigidly-coupled to an external support of a flexographic printing system (not depicted in FIG. 4), which may be similar to the system 100 schematically depicted in FIG. 1. The doctor blade stiffener plate 4 may be rotatably-coupled to the first doctor blade mounting arm 1 and the second doctor blade mounting arm 2 such that the doctor blade stiffener plate 4 may rotate about that axis 404. Further, this rotating may be facilitated by the thrust bearing 26. As such, because the doctor blade (not depicted in FIG. 4) is clamped between the doctor blade stiffener plate 4 and the stiffener plate 5, rotation of the doctor blade stiffener plate 4 about axis 404 also causes the doctor blade to rotate.

One or more of the adjustment shafts 406*a* and 406*b* may be urged towards one or more of the doctor blade loading arms 7.1 and 7. Shafts 406*a* and/or 406*b*, may be actuated via one or more of the doctor blade adjustment knobs 9 and 9.1, which may be done mechanically, electro-mechanically, or electrically. Additionally, the doctor blade adjustment knobs 9 and 9.1 may be adjusted manually, or automatically using a general-purpose computer or one or more application-specific integrated circuits, among others. It is further contemplated that the doctor blade holder and adjustment mechanism 200 may include one or more electronic sensors that provide data on the operation of the mechanism 200. These sensors may include, among others, an accelerometer, a strain gauge, a gyroscope, a thermometer, a camera, a microphone, or a hygrometer sensor.

The doctor blade loading arms 7 and 7.1 may be rigidly-coupled to the doctor blade stiffener plate 4, as depicted. As such, actuation of one or more of the doctor blade adjustment knobs 9 and 9.1 may impart a moment on the doctor blade stiffener plate 4 about axis 404 causing the doctor blade stiffener plate 4 to rotate. In this way, the doctor blade adjustment knobs 9 and 9.1 may be utilized to adjust a position of the doctor blade (not depicted in FIG. 4). Further, manual actuation of one or more of the doctor blade adjustment knobs 9 and 9.1 that results in one or more of the adjustment shafts 406*a* and 406*b* being urged in that direction indicated by arrow 408 results in the doctor blade stiffener plate 4, and hence, the doctor blade, being rotated into/toward the anilox roller (e.g. roller 106 from FIG. 1). Conversely, actuation of one or more of the doctor blade adjustment knobs 9 and 9.1 resulting in one or more of the adjustment shafts 406*a* and 406*b* moving in a direction opposite that indicated by arrow 408 may rotate the doctor blade stiffener plate 4 away from the anilox roller. A connecting shaft 14 may extend between and be rigidly coupled to the first and second doctor blade mounting arms 1 and 2. In one example, the connecting shaft 14 may serve as a stop element configured to prevent the doctor blade stiffener plate 4 from being rotated into the anilox roller beyond a predetermined stop point or position.

A doctor blade ink flap 6 may be rigidly coupled to the doctor blade stiffener plate 5 by fasteners 22 in order to contain any dispersion of ink when the doctor blade is scraping the anilox roller 106.

Figure 5:
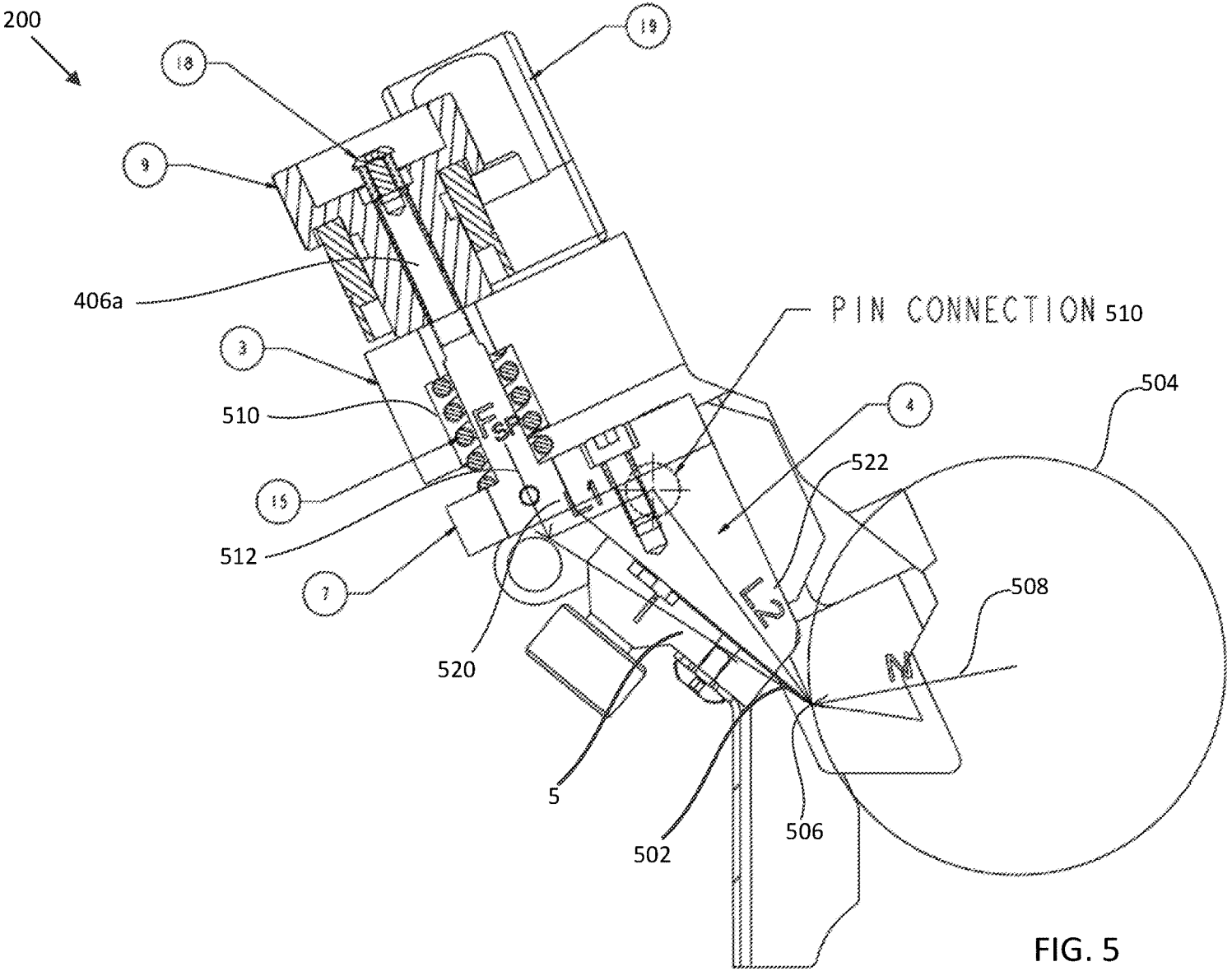
FIG. 5 depicts a partial cross-sectional view of the doctor blade holder and adjustment mechanism, according to one or more aspects described herein.

FIG. 5 depicts a partial cross-sectional view of the doctor blade holder and adjustment mechanism 200, according to one or more aspects described herein. In one implementation, FIG. 5 depicts a cross-sectional view through the center of the doctor blade adjustment knob 9. FIG. 5 further depicts a doctor blade 502 clamped between a first doctor blade stiffener plate 4 and a second doctor blade stiffener plate 5. An anilox roller 504 is schematically depicted in FIG. 5, and contacts the doctor blade 502 at a point of contact 506. In one implementation, the doctor blade 502 is pressed against the anilox roller 504 such that there is a normal force at the point of contact 506, as schematically depicted by arrow 508.

In one example, the doctor blade stiffener plate 4 is rotatable about axis through the indicated pin connection 510. As such, a distance between the point of contact 506 and the pin connection 510 is labeled as length L2 (referred to in FIG. 7). As previously discussed, actuation of the adjustment knob 9 may urge the adjustment shaft 406*a* toward or away from the doctor blade loading arm 7. In turn, this actuation of the adjustment shafts 406*a* may impart a moment about the pin connection 510, causing the doctor blade stiffener plate 4, and hence, the doctor blade 502, to rotate toward or away from the anilox roller 504.

Is contemplated that the doctor blade adjustment knob 9 may form part of an adjustment knob mechanism that may include, among others, the adjustment knob indicator 12 and the adjustment shaft 406*a*. The adjustment knob indicator 12 may configured to provide a visual indication/measurement corresponding to a position of the adjustment shaft 406*a*, and thus, the doctor blade 502. The adjustment knob indicator 12 may utilize any measurement scale, and may include an analog or a digital output, without departing from the scope of these disclosures. Accordingly, the doctor blade adjustment knob mechanism may be utilized to set a constant displacement/position of the doctor blade 502. In one implementation, the described constant displacement/position functionality may contrast with a constant force methodology utilized in alternative implementations of a doctor blade holder. Advantageously, the constant displacement of the doctor blade 502 that is set by the doctor blade holder and adjustment mechanism 200 may reduce wear, and hence, prolong a working life of the doctor blade 502 relative to alternative methodology that utilizes a constant force that presses a doctor blade against an anilox roller. Accordingly, when the doctor blade 502 wears down when in a first position, the displacement may be adjusted, using the doctor blade adjustment knob 9, and the doctor blade 502 may be moved to a second position that is closer to the anilox roller 504. As such, the doctor blade 502 may be repositioned multiple times as it wears down, which may increase the working lifetime of the doctor blade 502 when compared to alternative systems that may utilize constant force methodology.

It will be recognized that the adjustment knob mechanism that includes one or more of the doctor blade adjustment knob 9, adjustment knob indicator 12 and adjustment shaft 406*a* may be embodied as a linear actuator. In one implementation, this linear actuator may include a screw actuator. However, it is contemplated that any linear actuator mechanism may be utilized without departing from the scope of these disclosures. In one implementation, there may be multiple tolerances associated with the linear actuator (e.g. tolerances associated with the various screw threads utilized for the doctor blade adjustment knob 9 and adjustment shaft 406*a*, among others). It is contemplated that any screw thread dimensions (e.g. thread angle, thread pitch, thread depth, or pitch diameter, among others) and any screw thread tolerances may be utilized with the linear actuator, without departing from the scope of these disclosures. Further, these tolerances may give rise to backlash within the linear actuator due to tolerance stack up. Accordingly, the linear actuator may utilize a backlash compression spring 15 that is compressed between the adjustment knob mechanism and the doctor blade stiffener plate 4. In one specific example, and as depicted in FIG. 5, the backlash compression spring 15 may be compressed between the doctor blade loading arm 7 and the doctor blade loading brace 3. In one of the mentation, the backlash compression spring 15 may be held within a cavity 510 within the doctor blade loading brace 3. The spring force exerted by the compressed spring may act along that direction indicated by arrow 512, with the spring force serving to reduce or remove hysteresis as a result of tolerance stack up within the adjustment knob mechanism.

In one implementation, the backlash compression spring 15 may include a coil spring embodied with any spring constant, without departing from the scope of these disclosures. In yet another embodiment, a constant force spring may be utilized. In one example, the backlash compression spring 15 may have a spring constant ranging between 700 and 800 lb/in (79 and 90 N/m). In one implementation, the backlash compression spring 15 may have a spring constant of 777.7 lb/in (87.9 N/m). In one example, the backlash compression spring 15 may include a cylindrical spring with a constant pitch. Alternatively, the backlash compression spring 15 may include alternative spring geometries, without departing from the scope of these disclosures. For example, the backlash compression spring 15 may include a cylindrical spring with a variable pitch, or may include a conical, an hourglass, or a barrel geometry.

The spring force associated with the backlash compression spring 15 may also be utilized to maintain a steady pressure on the doctor blade 502, and thereby prevent fluctuation of the pressure on the doctor blade 502 due to mechanical vibration as a result of motion of the various components that make up a flexographic printing system similar to the system schematically depicted in FIG. 1 (otherwise referred to as "blade chatter").

In one example, the doctor blade holder and adjustment mechanism 200, as depicted in FIG. 5, may be utilized to provide a combination of adjustability of the doctor blade 502. For example, the doctor blade holder and adjustment mechanism 200 may be utilized to adjust one or more of the pressure, angle, and displacement of the doctor blade 502. In particular, the pressure may be maintained by the spring force along the direction 512 as a result of the backlash compression spring 15. An angle of the doctor blade 502 may be adjustable by pivoting the doctor blade stiffener plate 4 about the pin connection 510. Additionally, a displacement of the doctor blade 512 may be held at a constant position by the actuator, as actuated by the doctor blade adjustment knob 9.

Figure 6:
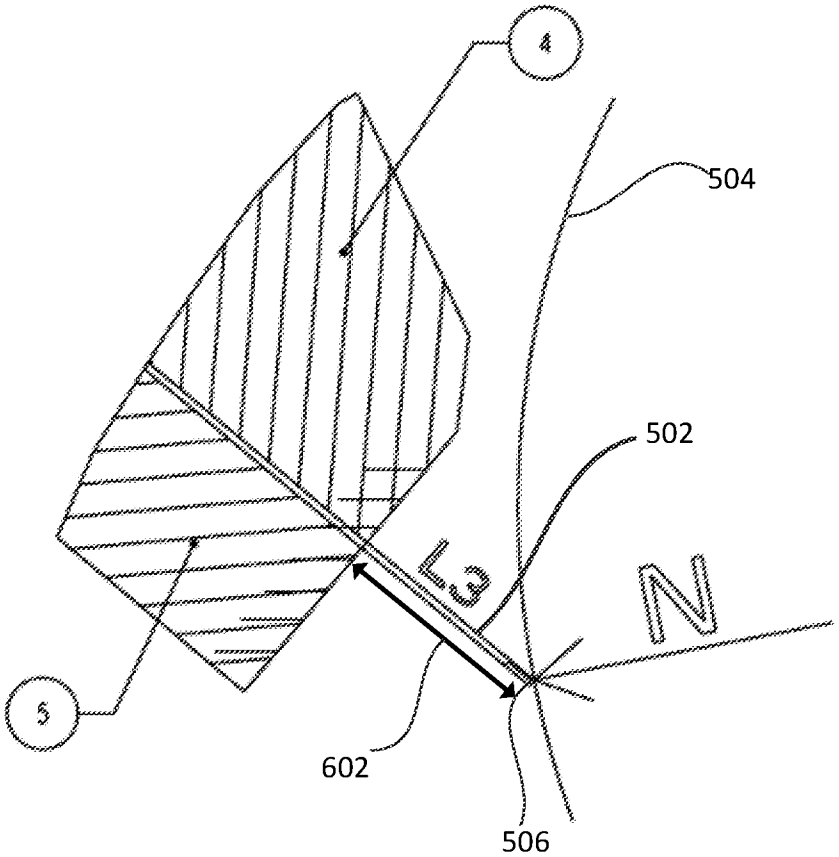
FIG. 6 depicts a cross-sectional sectional view of a portion of the doctor blade stiffener plates from FIG. 5, according to one or more aspects described herein.

FIG. 6 depicts a cross-sectional view of a portion of the first doctor blade stiffener plate 4 and the second doctor blade stiffener plate 5 from FIG. 5. In particular, the first doctor blade stiffener plate 4 and the second doctor blade stiffener plate 5 are depicted as clamping the doctor blade 502 therebetween. However, a portion of the doctor blade 502 extends beyond the first doctor blade stiffener plate 4 and the second doctor blade stiffener plate 5. The cantilevered length of the doctor blade 502 is depicted in further detail in FIG. 6, and labelled as length L3 (length 602). Length L3 is described in further detail in relation to FIG. 8.

Figure 7:
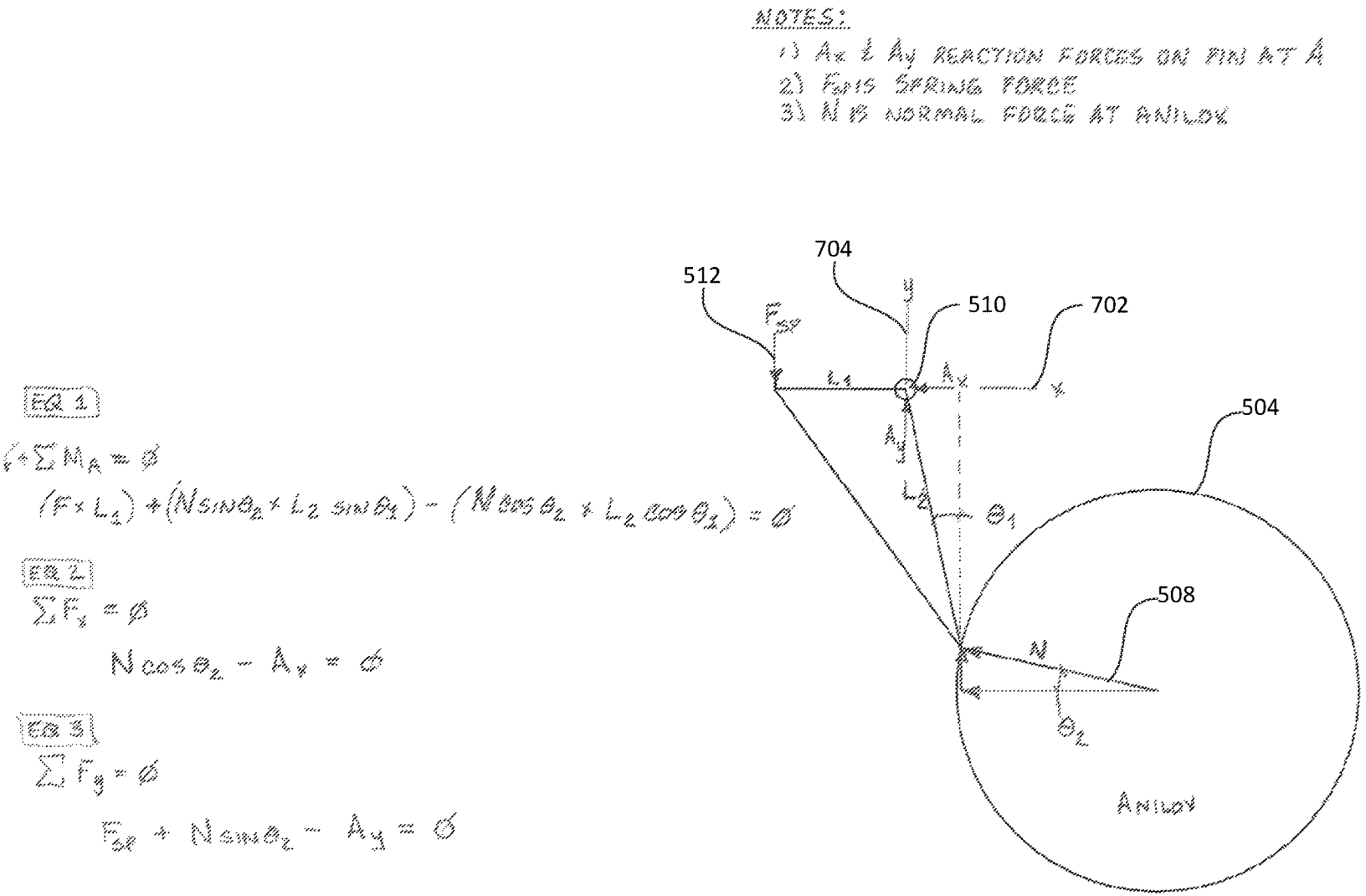
FIG. 7 schematically depicts a forced diagram associated with components described in relation to FIG. 5, according to one or more aspects described herein.

FIG. 7 schematically depicts a force diagram associated with components described in relation to FIG. 5, according to one or more aspects described herein. In particular, FIG. 7 considers the forces relative to the pin connection 510 as described in FIG. 5, and referred to as point "A" in the force diagram of FIG. 7. The pertinent forces with respect to pin "A"/the pin connection 512 may include reaction forces at the point "A" along the x-direction corresponding to axis 702, $A_x$, and along the y-direction corresponding to axis 704, $A_y$. Those additional forces of interest include the spring force 512, as described in FIG. 5, as well as the normal force 508 associated with the contact between the doctor blade 502 and the anilox roller 504. Lengths L1 and L2, as depicted in FIG. 7, correspond to those lengths L1 (520) and L2 (522) depicted in FIG. 5. Accordingly, Equation 1 from FIG. 7 considers the sum of the moments about point A and sets them equal to zero (i.e. Equation 1 considers a static system without rotation). Equation 2 considers the sum of the forces in the x-direction (i.e. along axis 702) and sets them equal to zero (i.e. Equation 2 considers a static system without translation along the x-direction). Equation 3 considers the sum of the forces in the y-direction (i.e. along axis 704) and sets them equal to zero (i.e. Equation 3 considers a static system without translation along the y-direction).

Figure 8:
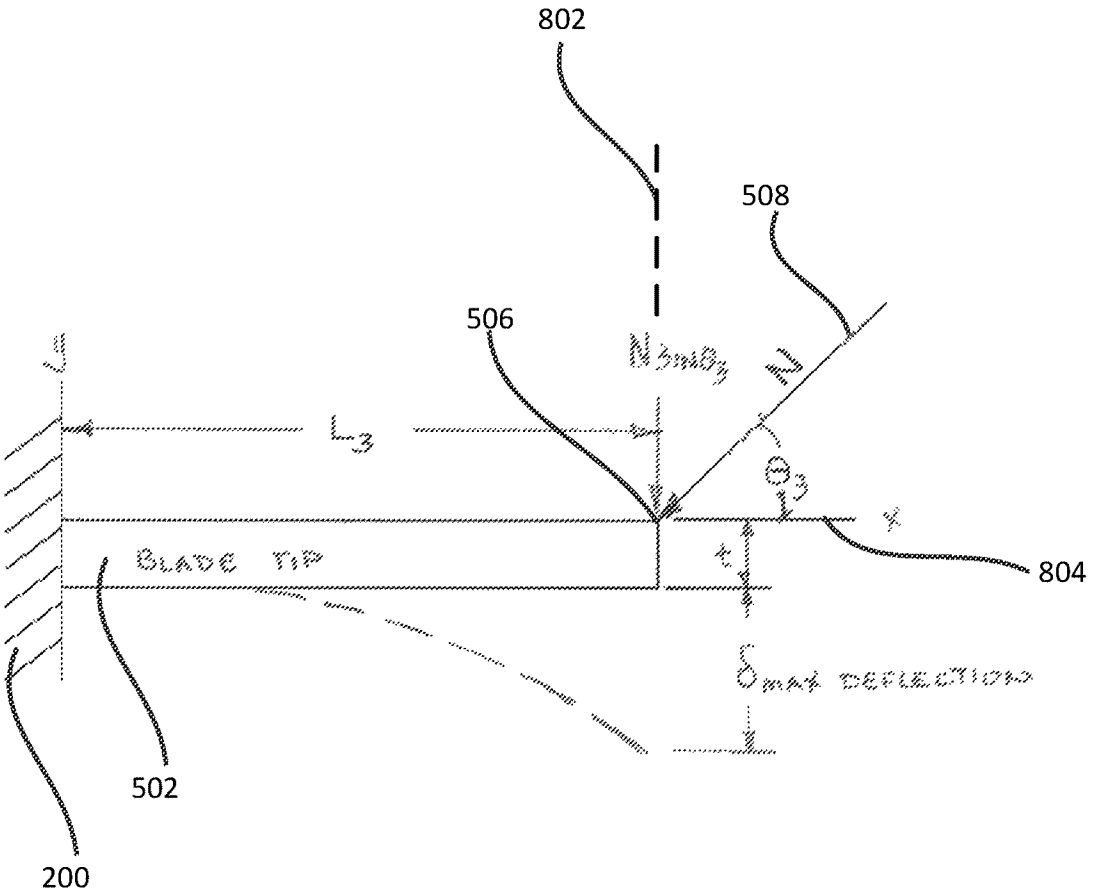
FIG. 8 schematically depicts deflection of a doctor blade tip as a result of the normal force exerted by an anilox roller on the doctor blade, according to one or more aspects described herein.

FIG. 8 schematically depicts deflection of the doctor blade tip as a result of the normal force exerted by the anilox roller on the doctor blade, according to one or more aspects described herein. As described in relation to FIG. 6, a length of the doctor blade 502 will extend beyond the support structure provided by the doctor blade holder and adjustment mechanism 200. This cantilevered length of the doctor blade 502, otherwise referred to as the "blade tip" is schematically depicted as having a length L3 corresponding to that length L3 described in relation to FIG. 6. Additionally, the doctor blade 502 may have a thickness, t, as schematically depicted in FIG. 8. As previously described in relation FIG. 5, when the doctor blade 502 is brought into contact with the anilox roller 504, a normal force 508 is set up at the point of contact 506. It will be understood that this normal force 508 will deflect the blade tip of the doctor blade 502, which is considered a cantilevered beam. Accordingly, the maximum deflection of the blade tip, δ-max, is given by the formula for a cantilevered beam:

$$\delta_{max} = \frac{P \cdot L_3^3}{3EI} \quad \text{(Equation 4)}$$

Where P is the component of the normal force 508 along a y-axis 802, E is the Young's Modulus of the material from which the doctor blade 502 is constructed, and I is the second moment of area of the doctor blade 502 with respect to an axis through the center of the doctor blade 512 (not depicted in FIG. 8, but perpendicular to the x-axis 804 and y-axis 802). This second moment of area of the doctor blade will depend upon the thickness, t, and a length, $L_z$, of the doctor blade 502 along the z-axis (not depicted in FIG. 8 but perpendicular to the x-axis 804 and y-axis 802), as given in Equation 5:

$$I = \frac{L_z \cdot t^3}{12} \quad \text{(Equation 5)}$$

Is to be understood that the various components described herein may be constructed using any material capable of withstanding forces associated with a flexographic printing systems. As such, for the various components described in these disclosures, one or more metals, alloys, polymers, fiber-reinforced materials, ceramics, or natural materials may be utilized, without departing from the scope of these disclosures.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

What is claimed is:

1. A doctor blade holder, comprising:
- a loading brace;
- a doctor blade stiffener plate rotatably coupled to the loading brace at a first and a second end, and configured to be rigidly coupled to a doctor blade at a bottom side;
- an adjustment knob mechanism;
- an adjustment shaft, configured to linearly translate responsive to manual actuation of the adjustment knob mechanism, wherein linear translation of the adjustment shaft is translated into rotation of the doctor blade stiffener plate relative to the loading brace;
- a backlash compression spring configured to be compressed between the adjustment knob mechanism and the doctor blade stiffener plate,
- first and second doctor blade mounting arms rigidly-coupled to the loading brace;
- a connecting shaft rigidly coupled between the first and second doctor blade mounting arms;
- wherein a spring force exerted by the backlash compression spring on the doctor blade stiffener plate reduces backlash from tolerance stack up in the adjustment knob mechanism, and
- wherein the doctor blade stiffener plate is configured to hold the doctor blade at a constant displacement position.

2. The doctor blade holder of claim 1, wherein rotation of the doctor blade stiffener plate moves the doctor blade toward or away from an anilox roller of a flexographic printing system.

3. The doctor blade holder of claim 1, wherein the doctor blade stiffener plate is a first stiffener plate, and the doctor blade holder further comprises a second stiffener plate, and wherein the doctor blade is clamped between the first and second stiffener plates.

4. The doctor blade holder of claim 3, further comprising an ink flap that is rigidly coupled to the second stiffener plate.

5. The doctor blade holder of claim 1, wherein the first and second doctor blade mounting arms comprise respective first and second thrust bearings that rotatably couple the doctor blade stiffener plate to the loading brace.

6. The doctor blade holder of claim 1, wherein the connecting shaft is a stop element that prevents the doctor blade stiffener plate from being rotated beyond a predetermined stop position.

7. The doctor blade holder of claim 1, further comprising a doctor blade loading arm rigidly coupled to the doctor blade stiffener plate, wherein the adjustment shaft is configured to exert a force on the doctor blade loading arm resulting in a moment about a rotational axis through the doctor blade stiffener plate.

8. The doctor blade holder of claim 1, wherein the backlash compression spring has a spring constant between 700 and 800 lbs./in.

9. The doctor blade holder of claim 1, wherein the backlash compression spring is a cylindrical spring with a constant pitch.

10. A doctor blade holder, comprising:

a doctor blade stiffener plate configured to be rigidly coupled to a doctor blade at a bottom side, and configured to rotate relative to an anilox roller of a flexographic printing system;

an adjustment knob mechanism;

an adjustment shaft, configured to linearly translate responsive to actuation of the adjustment knob mechanism, wherein linear translation of the adjustment shaft urges the doctor blade stiffener plate to rotate;

a backlash compression spring configured to be compressed between the adjustment knob mechanism and the doctor blade stiffener plate, first and second doctor blade mounting arms rotatably-coupled to the doctor blade stiffener plate, a connecting shaft rigidly coupled between the first and second doctor blade mounting arms, and wherein a spring force exerted by the backlash compression spring on the doctor blade stiffener plate reduces backlash from tolerance stack up in the adjustment knob mechanism.

11. The doctor blade holder of claim 10, wherein the doctor blade stiffener plate is configured to hold the doctor blade at a constant displacement position.

12. The doctor blade holder of claim 10, wherein the doctor blade stiffener plate is a first stiffener plate, and the doctor blade holder further comprises a second stiffener plate, and wherein the doctor blade is clamped between the first and second stiffener plates.

13. The doctor blade holder of claim 10, wherein the first and second doctor blade mounting arms further comprise respective first and second thrust bearings that rotatably couple the doctor blade stiffener plate to the first and second doctor blade mounting arms.

14. The doctor blade holder of claim 10, wherein the connecting shaft is a stop element that prevents the doctor blade stiffener plate from being rotated beyond a predetermined stop position.

15. The doctor blade holder of claim 10, further comprising a doctor blade loading arm rigidly coupled to the doctor blade stiffener plate, wherein the adjustment shaft is configured to exert a force on the doctor blade loading arm resulting in a moment about a rotational axis through the doctor blade stiffener plate.

16. The doctor blade holder of claim 10, wherein the backlash compression spring has a spring constant between 700 and 800 lbs./in.

17. The doctor blade holder of claim 10, wherein the backlash compression spring is located between the adjustment knob mechanism and a doctor blade loading arm, wherein the doctor blade loading arm is rigidly coupled to the doctor blade stiffener plate.

* * * * *